United States Patent [19]

Geizer et al.

[11] 3,975,689

[45] Aug. 17, 1976

[54] BETATRON INCLUDING ELECTROMAGNET STRUCTURE AND ENERGIZING CIRCUIT THEREFOR

[76] Inventors: Alfred Albertovich Geizer, ulitsa Nikitina, 4, kv. 4-8; Vladimir Lukyanovich Chakhlov, pereulok Zavodskoi, 8/1, kv. 6, both of Tomsk, U.S.S.R.

[22] Filed: Feb. 4, 1975

[21] Appl. No.: 546,940

Related U.S. Application Data

[63] Continuation of Ser. No. 445,997, Feb. 26, 1974, abandoned.

[52] U.S. Cl. ..... 328/237; 315/236; 315/240; 315/344

[51] Int. Cl.[2] ..... H05H 7/04; H05H 11/00

[58] Field of Search ..... 328/237; 315/62, 236, 315/240, 242, 244, 344

[56] References Cited

UNITED STATES PATENTS

| | | | |
|---|---|---|---|
| 2,697,167 | 12/1954 | Kerst | 328/237 |
| 2,773,183 | 12/1956 | Gund et al. | 328/237 |
| 2,797,322 | 6/1957 | Von Arx | 328/237 |

FOREIGN PATENTS OR APPLICATIONS

| | | | |
|---|---|---|---|
| 842,519 | 6/1952 | Germany | 328/237 |

*Primary Examiner*—Palmer C. Demeo
*Attorney, Agent, or Firm*—Holman & Stern

[57] ABSTRACT

A betatron is disclosed comprising an electromagnet having the gap thereof defined by the shaped tips of its pair of pole cores contains therewithin a vacuum accelerating chamber. The gap contains therewithin at least one bias winding connected in series with the magnetizing winding of the electromagnet. Both windings are excited by one and the same current pulse generator and are coupled to its energy accumulator via the switching elements of the generator. The switching elements of the generator, which return the energy stored by the electromagnet to the accumulator, are coupled to the magnetizing winding.

10 Claims, 3 Drawing Figures

BETATRON INCLUDING ELECTROMAGNET STRUCTURE AND ENERGIZING CIRCUIT THEREFOR

This is a continuation of application Ser. No. 445,997 filed Feb. 26, 1974, now abandoned.

BACKGROUND OF THE INVENTION

The present invention relates generally to charged-particle accelerators, and more particularly it relates to betatrons used for flaw detection in a variety of materials and articles.

It is known in the art to employ betatrons comprising an electromagnet with at least one magnetizing winding and at least one gap defined by the profiled tips of a pair of pole cores, the gap containing therewithin a toroidal vacuum accelerating chamber and at least one bias winding which changes the field distribution within the gas and which is excited together with the magnetizing winding by current pulses produced as an energy accumulator is discharged via switching elements into the mentioned windings.

In these betatrons, the magnetizing winding sets up a time-variable magnetic field in the gap of the electromagnet. Over the section where the field intensity rises, the electrons introduced into the accelerating chamber acquire the required energy. At the instant when the magnetic field intensity is at its maximum, in order to extract the electrons or direct them to the target, current pulses are sent through the bias winding, so that the field distribution in the gap changes and the electrons are displaced from their initial paths. In order to set up these fields, the magnetizing and bias windings are excited by independent current pulse generators, each comprising a control circuit.

The above-described known betatrons are too sophisticated. The independent current pulse generators complicate the circuitry of the betatron, detract from its reliability and also add to the size and weight of the betatron.

SUMMARY OF THE INVENTION

It is an object of the present invention to provide a betatron with simplified electric circuitry, of a smaller size and weight and with a lower power input.

This object is attained in a betatron, comprising an electromagnet with at least one magnetizing winding and at least one gap defined by the shaped tips of a pair of pole cores of the electromagnet, the mentioned gap containing therewithin a toroidal vacuum accelerating chamber and at least one bias winding changing the field distribution within the gap and together with the magnetizing winding excited by current pulses which arise as an energy accumulator is discharged via switching elements into the windings, according to the invention, the bias winding is connected in series with the magnetizing winding, both windings being excited by a single current pulse generator which operates into the mentioned windings, the latter being connected to an energy accumulator via switching elements, and the switching elements which return the energy stored by the electromagnet to the accumulator are coupled to the magnetizing winding.

BRIEF DESCRIPTION OF THE DRAWINGS

An embodiment of the present invention will now be described, by way of example, with reference to the accompanying drawings, wherein.

DETAILED DESCRIPTION OF THE PREFERRED EMBODIMENT

The betatron of this invention has a smaller weight and size, consumes less power and has simplified electric circuitry as compared to the known ones.

Figure 1:
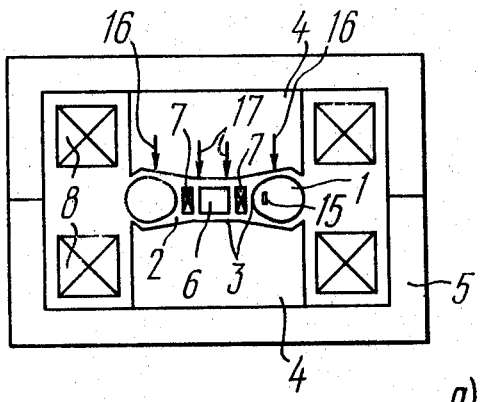
FIG. 1 is a schematic representation of the betatron of the present invention.
Figure 2:
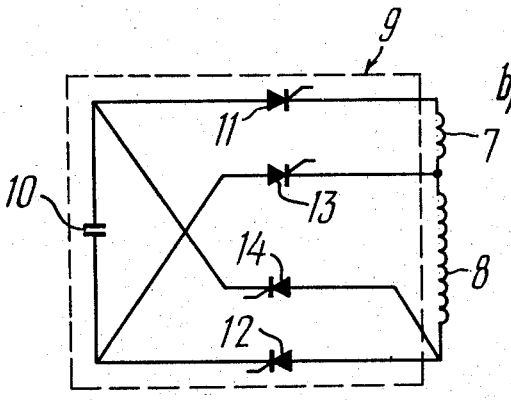
FIG. 2 is a schematic circuit diagram of the proposed betatron, in accordance with the invention.

Referring now to FIG. 1, the betatron of this invention is a unit housed in a single case (not shown) which comprises a toroidal vacuum accelerating chamber 1 disposed within a gap 2 defined by profiled tips 3 of pole cores 4, the latter being closed by a feedback magnetic circuit 5. A ferromagnetic insert 6 and a bias winding 7 are disposed within the gap 2, in that part thereof which is defined by the inner walls of the vacuum chamber 1. A magnetizing winding 8 is disposed on the pole cores 4 and, just as the bias winding 7 connected in series therewith, it is excited by a current pulse generator 9 (FIG. 2) from an energy accumulator 10 via switching elements 11 and 12, the energy stored in the magnetizing winding 8 being returned to the accumulator 10 via switching elements 13 and 14 coupled to the terminals of the magnetizing winding 8.

The energy accumulator 10 and the switching elements 11, 12, 13 and 14 in the embodiment being described are formed as a capacitor and thyristors, respectively.

The betatron also comprises a target 15 (FIG. 1) disposed interiorly of the accelerating chamber 1 close to the smaller-diameter wall. This target 15 is hit by the electrons accelerated and displaced by the magnetic field of the betatron, the electrons being supplied into the chamber 1 using known electron injection means (not shown).

For the sake of convenience, FIG. 1 shows lines of force 16 and 17 of the control and accelerating magnetic fluxes set up by the betatron windings 7 and 8.

The above-described current pulse generator 9 is controlled, in the embodiment being described, by a known control device (not shown) which comprises a self-excited oscillator and a delay circuit, both being built around thyristors.

An alternative embodiment of the proposed betatron is likewise feasible with two gaps defined by the profiled tips of two pairs of pole cores, each gap containing therewithin a vacuum accelerating chamber.

The principle of operation of the proposed betatron is as follows.

At the instant $t_o$ (FIG. 3*b*), the self-excited oscillator of the control device sends trigger pulses to the switching elements 11 (FIG. 2) and 12, and the precharged capacitor starts discharging into the windings 7 and 8 which set up a control and an accelerating fluxes in the gap 2 (FIG. 1).

Figure 3:
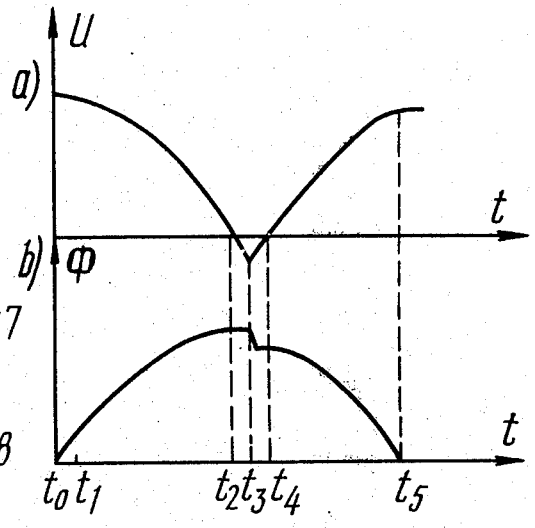
FIG. 3 (a,b) represents curves of voltage variation on the accumulator and of accelerating magnetic flux variation in the gap of the proposed betatron, respectively.

To give a better idea of how the proposed betatron operates, FIG. 3 represents two timing charts *a* and *b*, with the time $t$ plotted as the abscissas, while the voltage U of the energy accumulator and the accelerating flux $\phi$ set up by the magnetizing and bias windings plotted as two respective ordinates.

The magnetizing winding 8 (FIG. 1) sets up both the control and the accelerating magnetic fields with the lines of force 16 and 17. Since the bias winding 7 envelops only the accelerating field, the latter is set up jointly by both windings 7 and 8.

At the instant $t_1$ (FIG. 3*b*), electrons are injected into the accelerating chamber 1 (FIG. 1) to accelerate in the magnetic field of the betatron and reach the maximum energy level at an instant $t_2$ (FIG. 3*b*). This is the instant when the accumulator 10 (FIG. 2) transmits all its energy to the magnetic field.

Over the interval from the instant $t_2$ to the instant $t_3$ (FIG. 3*b*) the energy accumulator, capacitor, is partially recharged. During this process, the negative voltage peak across the capacitor is negligible relative to the maximum voltage thereacross; hence, during the time interval from $t_2$ to $t_3$, the magnitude of the current through the betatron windings 7 (FIG. 1) and 8 will remain practically constant. Consequently, the magnitude of the magnetic flux $\phi$ (FIG. 3*b*) will be unchanged throughout that time interval, so that the electrons will have constant energy.

At the instant, $t_3$, the delay circuit of the control device of the generator 9 (FIG. 2) sends trigger pulses to the switching elements 13 and 14, formed as thyristors, thus rendering them conducting. The current through the switching elements 11 and 12, and hence through the bias winding 7, starts decreasing to zero. Over the $t_3$–$t_4$ time interval, the switching elements 11 and 12 fully restore their rectifying property.

From the instant $t_3$ (FIG. 3*b*), the energy stored in the bias winding 7 (FIG. 2) is returned to the accumulator 10. As the inductance of the winding 7 is far less than that of the magnetizing winding 8, the transfer of the energy stored in the bias winding 7 takes little time during which the current through the magnetizing winding 8 cannot vary significantly. As the current through the winding 7 starts decreasing at the instant $t_3$, so does the accelerating flux $\phi$ (FIG. 3*b*), displacing the electrons accelerated in the chamber 1 (FIG. 1) towards the target 15.

Over the $t_3$–$t_4$ time interval, the energy stored in the magnetizing winding 8 is returned to the energy accumulator 10 (FIG. 2) along a circuit formed by the generator 9, the switching element 13, the winding 8 and the switching element 14, thereby charging the capacitor and forming the decreasing part of the magnetic flux $\phi$ (FIG. 3*b*).

If the proposed betatron should employ a bias winding enveloping only the control magnetic flux, the processes occurring in the electric circuit of the current pulse generator will undergo no change. The only difference will be that the accelerated electrons will be displaced towards a target disposed in the accelerating chamber near the larger-diameter walls.

A betatron comprising two accelerating chambers operates in a manner similar to the one described hereabove.

The present invention permits of considerably simplifying the electric circuitry of the betatron, thereby effecting a reduction in its size and weight. The invention also reduces the input power requirements of the betatron.

What we claim is:

1. A betatron, comprising: an electromagnet; at least one magnetizing winding of said electromagnet; a pair of pole cores of said electromagnet; shaped tips of said pair of pole cores; said shaped tips of said pair of pole core defining at least one gap therebetween; a toroidal vacuum accelerating chamber disposed interiorly of said gap; at least one bias winding likewise disposed interiorly of said gap and adapted to change the field distribution within said gap, said bias winding being connected in series with said magnetizing winding; a current pulse generator operating into said magnetizing and bias windings; an energy accumulator of said current pulse generator; switching elements of said current pulse generator, said windings being coupled to said energy accumulator; additional switching elements of said current pulse generator which return the energy stored by said electromagnet to said accumulator, said additional switching elements being connected to said magnetizing winding of said generator.

2. A betatron, comprising: an electromagnet; at least one magnetizing winding of said electromagnet; a pair of pole cores of said electromagnet; shaped tips of said pole cores; said shaped tips of said pole cores defining at least one gap therebetween; a toroidal vacuum accelerating chamber disposed interiorly of said gap; at least one bias winding juxtaposed with said magnetizing winding; said magnetizing winding connected to a first and a second node, for producing a magnetic control flux and a magnetic acceleration flux in the betatron; said bias winding connected in series with said magnetizing winding, between said first node and a third node, for modifying the relative magnitudes of said acceleration flux and said control flux; an energy accumulator having a first and a second electrode, for storing energy to be discharged as an electric current into said magnetizing and said bias windings; a first switching element connected between said first electrode of said energy accumulator and said third node of said bias winding; a second switching element connected between said second node of said magnetizing winding and said second electrode of said energy accumulator; said energy accumulator having energy stored therein prior to the commencement of the excitation of said bias and magnetization windings; said first and second switching elements switching at a first time, conducting electric current from said energy accumulator through said bias and said magnetization windings, thereby producing said magnetic control and said magnetic acceleration fluxes in said betatron for the acceleration of charged particles injected therein, into a stable orbital state; a third switching element connected between said second electrode of said energy accumulator and said first node; a fourth switching element connected between said second node and said first electrode of said energy accumulator; said third and fourth switching elements switching at a second time after said energy accumulator has transferred said energy stored therein to said bias and magnetization windings; thereby decreasing the current through said bias winding and causing an abrupt change in the relative magnitudes of said magnetic acceleration and said magnetic control fluxes, thereby perturbing said accelerated charged particles out of their stable orbital state; said third and fourth switching elements conducting electric current from said magnetizing winding to said energy accumulator after said second time, thereby returning the energy stored in said magnetizing winding during the acceleration of said charged particles, to said accumulator.

3. The betatron of claim 2, wherein: said bias winding is disposed interiorly of said gap to modify the magnitude of said magnetic acceleration flux; whereby the orbit of said accelerated charged particles is forced to follow a path of decreasing radius vector after said second time.

4. The betatron of claim 2, wherein: said bias winding is disposed to envelope said magnetic control flux to modify the magnitude of said magnetic control flux; whereby the orbit of said accelerated charged particles is forced to follow a path of increasing radius vector after said second time.

5. The betatron of claim 2, wherein: said bias winding has an inductance with a magnitude substantially less than that for the inductance of said magnetizing winding.

6. The betatron of claim 2, wherein: said energy accumulator is a storage capacitor which stores said energy as an electric charge.

7. The betatron of claim 2, wherein: said switching elements are thyristors which are switched into conduction by a trigger pulse.

8. The betatron of claim 2, wherein: said energy accumulator is a storage capacitor wherein said energy stored prior to the commencement of the excitation of said bias and said magnetization windings is in the form of a positive electric charge on said first electrode and a negative electric charge on said second electrode; said first switching element is a first thyristor with its positive pole connected to said first electrode of said storage capacitor and its negative pole connected to said third node of said bias winding; said second switching element is a second thyristor with its positive pole connected to said second node of said magnetizing winding and its negative pole connected to said second electrode of said storage capacitor; said first and second thyristors being switched by a trigger pulse at said first time, to conduct positive current from said storage capacitor through said bias and magnetization windings; said third switching element is a third thyristor having its positive pole connected to said second electrode of said storage capacitor and its negative pole connected to said first node; said fourth switching element is a fourth thyristor having its positive pole connected to said second node and its negative pole connected to said first electrode of said storage capacitor; said third and fourth thyristors being switched by a trigger pulse at said second time, thereby decreasing the current through said bias winding and returning the energy stored in said magnetization winding to said storage capacitor.

9. The betatron of claim 8, wherein: said bias winding has an inductance with a magnitude substantially less than that for the inductance of said magnetizing winding.

10. The betatron of claim 9, wherein: said bias winding modifies the magnitude of said magnetic acceleration flux; whereby the orbit of said accelerated charged particles is forced to follow a path of decreasing radius vector after said second time.

* * * * *